United States Patent [19]

Grosbard et al.

[11] 3,992,286

[45] Nov. 16, 1976

[54] MINERAL ORE CONCENTRACTOR

[75] Inventors: Gregory Grosbard, New York, N.Y.; Hugh A. Ghiringhelli, Wilton, Conn.

[73] Assignee: Eocene Research (Entire) a Partnership, Wilton, Conn.

[22] Filed: Apr. 15, 1975

[21] Appl. No.: 568,189

[52] U.S. Cl. ..... 209/1; 209/3; 209/9

[51] Int. Cl.[2] ..... B03B 1/00

[58] Field of Search ..... 209/1, 3, 4, 9, 172, 209/127 R, 131; 204/180 R, 180 G, 186, 189

[56] References Cited

UNITED STATES PATENTS

| | | | |
|---|---|---|---|
| 2,914,453 | 11/1959 | Wennerberg | 204/186 |
| 3,133,876 | 5/1964 | Klass | 209/1 |
| 3,162,592 | 12/1964 | Pohl | 209/127 R X |

OTHER PUBLICATIONS

Pohl, "Nonuniform Electric Fields," Scientific American, vol. 203, No. 6, Dec. 1960.

*Primary Examiner*—Frank W. Lutter
*Assistant Examiner*—Ralph J. Hill
*Attorney, Agent, or Firm*—Jacob Shuster; Harvey B. Jacobson

[57] ABSTRACT

A desirable metal such as gold in a low grade ore has its concentration increased by electro-kinetically separating gangue from other components in the ore to form a concentrate. Separation is effected by inducing movement of externally conductive particles upwardly and radially outwardly over the walls of a container enclosing a dielectric liquid within which the ore is initially contained. An electric field is established for this purpose between the container walls and an electrode positioned above the surface of the dielectric liquid.

7 Claims, 4 Drawing Figures

MINERAL ORE CONCENTRACTOR

This invention relates to the concentration of desirable materials, such as metals, in an ore beneficiation process.

The use of electro-kinetic means for ore beneficiation purposes is well known although not widely employed. Electrostatic separation as one form of electro-kinetic concentration of a metal is referred to, for example, in U.S. Pat. No. 3,063,561 to Snow. Another type of electro-kinetic separation, known as electrophoresis is disclosed in U.S. Pat. No. 3,712,859 to Dilworth. In the latter type of process, solid matter is colloidally suspended in an electrolytic liquid through which an electric field is established to effect migration of certain components toward a collection zone. Such prior known methods because of the cost of equipment and/or the limitations and conditioning required with respect to ores being treated, are not commercially feasible for processing mineral ores in an economical fashion. It is therefore an important object of the present invention to provide an economical method of concentrating desirable components in a mineral ore, and in particular, a low grade ore by electro-kinetic means.

In accordance with the present invention a low grade ore, the solid particles of which are previously reduced in size to a predetermined size range and having some surface conductivity, is placed in a container immersed within a body of dielectric liquid. An electrode is positioned above the surface of the dielectric liquid and an electrical power supply establishes an electric field extending from the electrode through the container causing movement of the solid particles in the mass of ore upwardly and radially outwardly over the walls of the container. The particles begin to spill over the rim of the container into a separation zone outside the container. Since particles of different components of the ore move at different rates under electro-kinetic inducement, exposure to the electric field may be timed so as to avoid extraction of the desirable components from the slower moving mass within the container. By the foregoing method, the concentration of gold in a low grade ore was increased by as much as 1400% during a single operational cycle.

These together with other objects and advantages which will become subsequently apparent reside in the details of construction and operation as more fully hereinafter described and claimed, reference being had to the accompanying drawings forming a part hereof, wherein like numerals refer to like parts throughout.

Figure 1:
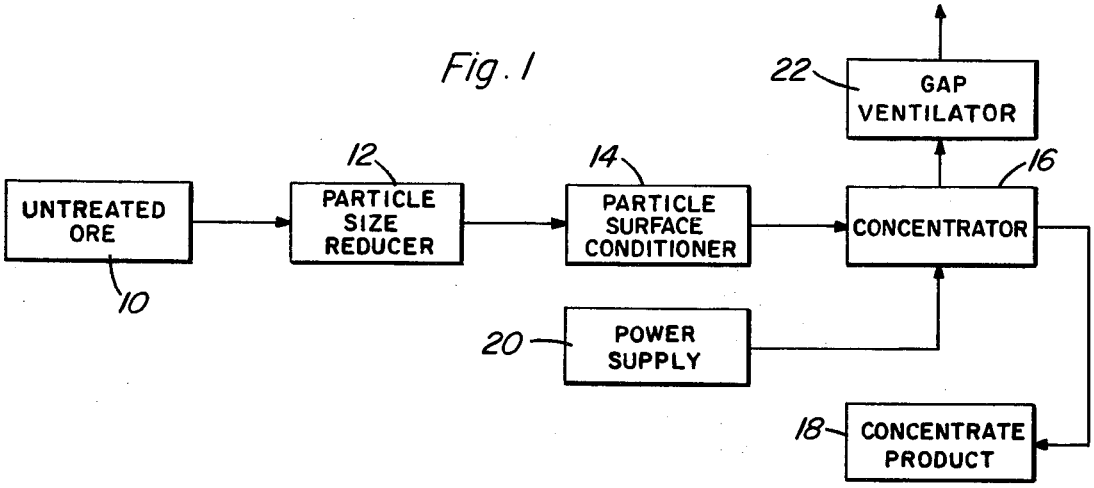
FIG. 1 is a block diagram outlining the basic method of the present invention.

Referring now to the drawings in detail, FIG. 1 depicts the processing of ore 10 by passage through a particle size reducer 12 such as a ball grinding mill wherein the ore is reduced in particle size and screened to obtain a size range suitable for processing, to obtain optimum concentration of the desirable component of the ore. Depending on their surface condition, the particle surfaces are then rendered electrically conductive in conditioner 14. Conditioning for purposes of this invention may be effected by coating of the ore particles with moisture, for example. The order in which the ore is ground and washed and possibly otherwise preconditioned, is not material. The ore is then fed to the concentrator 16 from which a concentrate 18 is obtained. The concentrator may include a plurality of ore concentrating units or stations through which the ore passes sequentially to obtain the desired degree of concentration. Electrical operating energy for the concentrator is derived from a power supply 20. To maintain constant operating conditions within the concentrator as will be explained hereinafter, any gases evolved in the concentrator during operation are removed by a gap ventilator 22.

Figure 2:
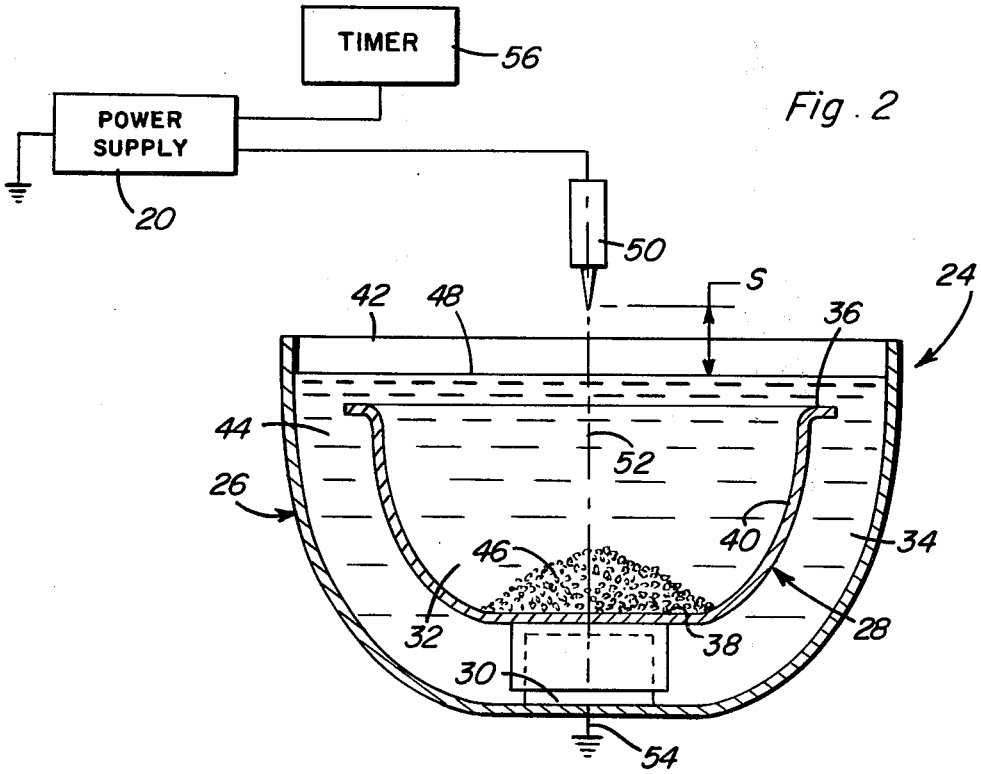
FIG. 2 is a simplified side sectional view of test apparatus utilized in carrying out the method of the present invention.

FIG. 2 illustrates laboratory test apparatus 24 corresponding to a basic concentrating unit or station that may be used in the concentrator component 16 aforementioned. The apparatus 24 includes an outer container 26 and an inner container 28 supported in spaced relation to the walls of the outer container by an electrically conductive base 30 that is grounded. The containers are made of an electrically conductive material such as stainless steel which will also resist corrosion. The inner container 28 defines a treating zone 32 separated from an external separation zone 34 by its upper rim 36. The actual shape of the containers 26 and 28 may vary and may be either stationary as shown or movably supported on a processing conveyor. Preferably, the internal walls of the inner container should rise symmetrically from a bottom supporting surface portion 38 along smooth curvature side portions 40 to the upper rim 36 which is spaced below the upper edge 42 of the outer container.

The inner container 28 is immersed within a body of dielectric liquid 44. In addition to the dielectric property of the liquid there are other property requirements that are critical to varying degrees including low viscosity and high specific gravity as well as non-flammability for safety purposes. Also, the liquid should be chemically inert relative to the material 46 being processed under the prevailing operating conditions. The dielectric property of the liquid avoids any ionization, electrolytic, electrophoretic or electro-chemical action within the treating zone. The liquid substantially fills the outer container to form an upper surface 48 exposed to atmosphere and spaced above the upper rim 36 of the inner container.

Closely spaced above the surface 48 of the liquid by an air gap distance S is an electrode 50. The electrode is fixedly positioned in symmetrical relation to the body of liquid in the inner container 28 or in alignment with its vertical geometric, central axis 52. The gap spacing S is adjusted to obtain optimum operating conditions as will be explained hereafter in regard to the electrode used. However, the shape and electrode material utilized was not found to be critical. The power supply 20 is connected to the electrode and supplies electrical energy thereto to establish a field potential difference between the electrode and the containers grounded at 54 which constitute surface electrodes. The duration of the electric field so established was registered and/or pre-set by a timer component 56 associated with the power supply.

Figure 3:
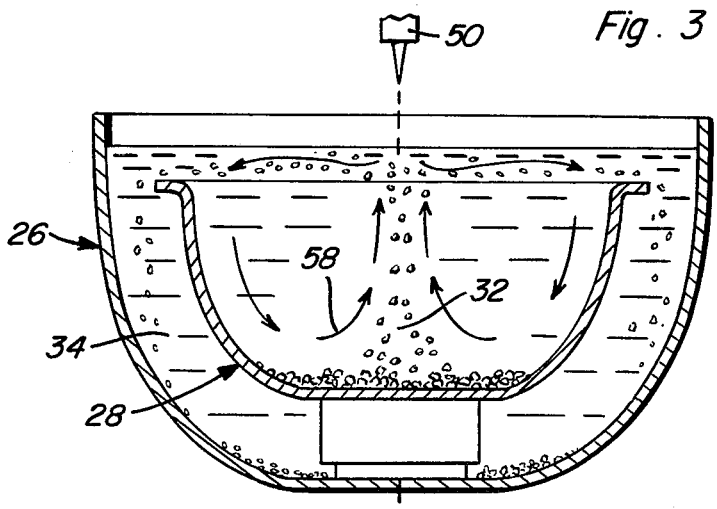
FIG. 3 is a side sectional view similar to FIG. 2, showing the observed electro-kinetic action.

To effect concentration of a desirable component of the material 46 settled on the bottom 38 of the inner container 28, the power supply 20 is turned on for a timed period during which a pulsating wave pattern was observed in the liquid 44. The wave pattern appeared to radiate from a central point below the electrode 50 producing internal currents in the liquid as depicted by arrows 58 in FIG. 3. The foregoing wave action was accompanied by relatively slow movement of the particles in the mass of material 46 along paths extending upwardly and radially outwardly over the walls of the container 28 resulting in spill over of the material into the separation zone 34. The rate of movement of particles of different components in the mass of material 46, differed from each other enabling concentration of selected components either by collection in the separation zone 34 or retention in the treating zone 32. The electric field was established for a timed period determined necessary to effect optimum concentration from the batch of material 46 during one operational cycle.

The present invention contemplates establishment of the electric field extending through the body of dielectric fluid 44 by other electrical arrangements. For example, either one of the containers 26 and 28 could be made of electrically non-conductive material as long as one of the containers is conductive so as to form a terminal with the electrode 50 between which the field potential is established. The polarity of the field and/or the connection of the power supply to the field potential terminals may also be reversed.

In accordance with the desirable property criteria hereinbefore set forth for the dielectric liquid, various liquids are presently contemplated as suitable including Freon, mineral oil, kerosene, carbon tetrachloride and trichloroethylene and various combinations of the foregoing. Different waveform characteristics are also contemplated for the electrical energy utilized to establish the electric field, including DC and AC power pulsating or oscillating at different frequencies. The selection of the dielectric liquid and waveform characteristics of the electrical energy will depend on the type of material being processed and other factors such as equipment geometry and costs.

Another factor to be considered in practicing the method of the present invention is the gap conditions. The spacing S of the gap between the electrode and the surface 48 of the dielectric liquid must be adjusted for optimum operating conditions and in accordance with other selected parameters. The spacing of the electrode from the surface of the dielectric liquid will involve some ionization of the air in the gap because its dielectric breakdown strength is lower than that of the dielectric liquid. To maintain constant operating conditions, the air gap should be ventilated so as to remove any dielectric gases evolved from the liquid which may alter the breakdown strength in the gap. The use of a blower to effect a forced flow of air is therefore contemplated for large industrial applications of the present invention. It will be apparent from the foregoing that the breakdown strength of the dielectric liquid will limit the maximum permissible voltage applied to establish the field potential, which accounts for the electro-kinetically induced movement of the particles from the mass 46. The electro-kinetically produced forces will be assisted by the buoyancy forces exerted by the liquid on the solid particles for which reason a high specific gravity is desirable for the liquid. A low viscosity of the liquid is also desirable to avoid the frictional impediment to movement incident to liquid viscosity.

The electro-kinetically induced movement of particles according to one theory occurs because of the surface charge imposed on the solid particles by the electric field potential and the exchange of charges between the particles and the surfaces of the containers, unaffected by the liquid insofar as charge exchange is concerned because of the dielectric property of the liquid. The acquisition and exchange of charges by the particles may, however, account for the wave and current action observed in the liquid which enhances the movement of the particles. The requirement that the particles have surface conductivity is therefore understandable. The amount of surface conductivity was not measured, however, since it was not found to be critical.

Actual test runs where performed in accordance with the present invention utilizing the test apparatus 24 to concentrate a batch of material 46 simulating a low grade gold ore having the following content:

| Components | Weight (Grams) |
|---|---|
| gangue | 9.50 |
| iron ores | 0.40 |
| silver ores | 0.08 |
| gold (free) | 0.02 |
| Total | 10.0 grams |

The test runs were performed for periods timed to separate as much of the mass 46 as possible without spill over of any of the gold particles into the separation zone 34. Accordingly, all of the 0.02 grams of gold remained in the concentrate retained in the treating zone 32 for each run. In each case, the power supply was set to deliver 22 kilovolts of DC power to the electrode, at 30 KH and 0.05 ripple, peak to peak. While the content of the mass 46 being concentrated, the weight of the gold in the concentrate and the electrical power was constant, other parameters were varied as indicated in the following examples of different test run series.

EXAMPLE A 48 ounces of Freon, T.F. ($CCl_2F$ - $CClF_2$) was used as the dielectric liquid. The mass of particles 46 was reduced in size to a size range of −80 to +100 mesh. Test runs were performed with the gap spacing adjusted between ⅜ and 1⅝ inches corresponding to a variation in current between 2.0 and 4.5 microamps and retention of a concentrate in the treating zone 32 of 0.64 to 0.98 grams. The variations in percent gold concentration and processing time for the adjusted electrode gap spacings, are summarized by curves 60 and 62 respectively, in FIG. 4.

EXAMPLE B

The same conditions were imposed as in Example A, except that the size range of the particles was enlarged to −140 to +170 mesh. The current varied between 2.2 and 5 microamps corresponding to a variation in concentrate retained of 0.76 to 1.10 grams. Curves 64 and 66 in FIG. 4, respectively summarize the variations in concentration of gold and processing time.

EXAMPLE C

Figure 4:
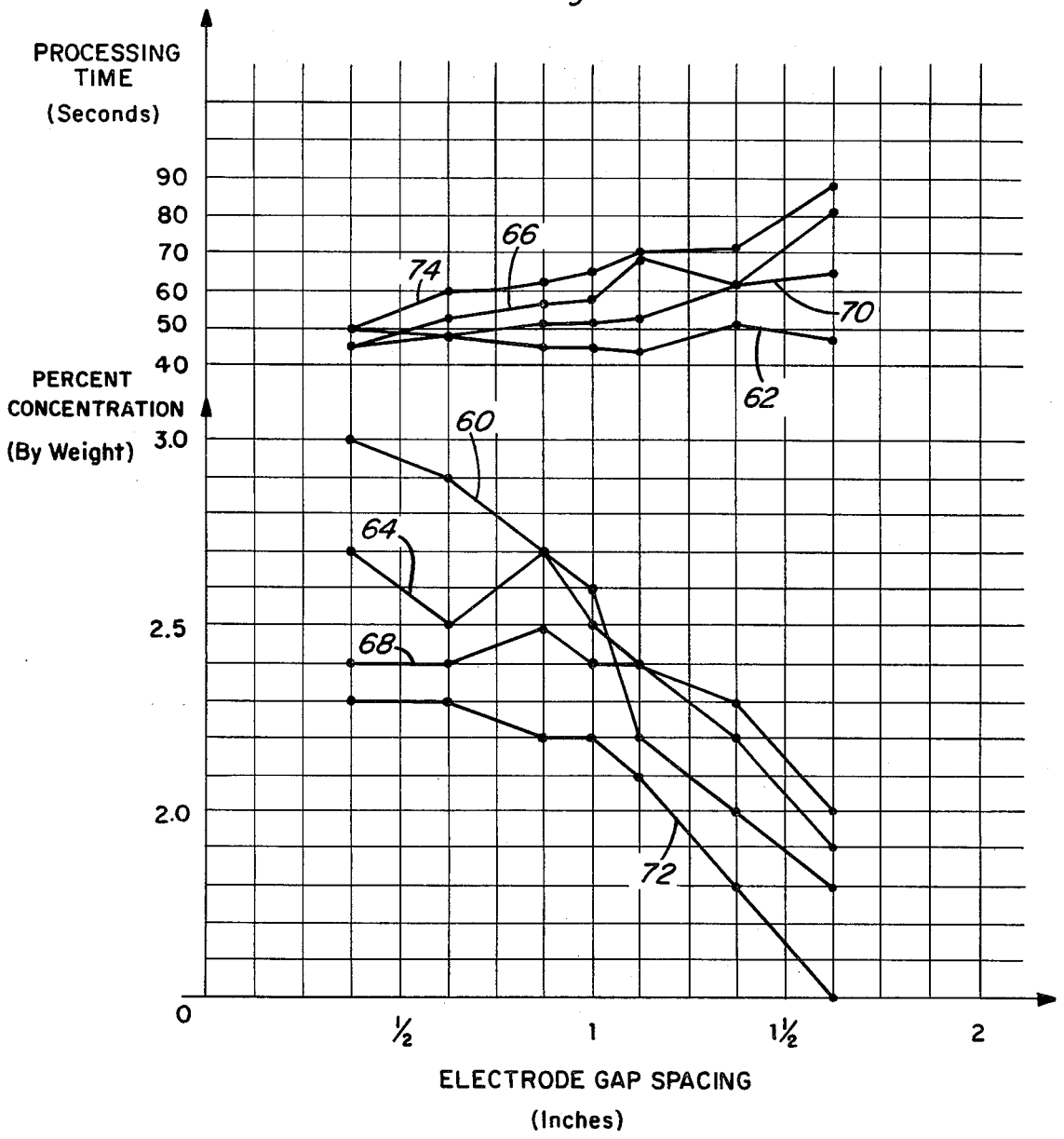
FIG. 4 is a graphical summary of various test runs performed with the apparatus depicted in FIG. 2.

In this series of test runs, 48 ounces of kerosene was used as the dielectric liquid, other conditions being the same as those specified under Example A. The current varied between 2.0 and 4.5 microamps corresponding to a variation in concentrate retained of 0.83 to 1.05 grams. Curves 68 and 70 in FIG. 4 depict the variations in gold concentration and processing time respectively.

EXAMPLE D

Except for the use of kerosene for the dielectric liquid, the conditions imposed on this series of test runs was the same as those specified under Example B. The current varied between 2.5 and 5.0 microamps corresponding to a variation in concentrate of 0.88 to 1.30 grams. Curves 72 and 74 show the variation in gold concentration and processing time.

It will be apparent from the foregoing test runs that reducing the size range of the particles enhances the concentrating process and that Freon is better than kerosene for closer electrode gap spacing. Closer gap spacing is generally better. More important, however, the concentration of gold was increased from 0.2% to as much as 3.0%, a 1400% increase.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. Apparatus for treating a mixture of solid materials having surface conductivity and different densities, comprising a container immersed in a body of dielectric medium and having a charge exchange surface on which said solid materials are supported, said solid materials being movable through the body of dielectric medium along paths extending externally of the container, means for applying a non-uniform electric field to said body of dielectric medium to displace said materials along said paths at different rates, and means for confining the body of dielectric medium and collecting solid materials displaced from the container along said paths, said field applying means including an electrode spaced by an air gap from an exposed surface of the body of dielectric medium.

2. Apparatus for concentrating a predetermined component in a mass of solid particles having surface conductivity, comprising a surface on which said mass of solid particles is supported, means for confining a body of dielectric fluid in contact with said supporting surface, means for applying a non-uniform electric field to said body of fluid, including at least one electrode mounted in spaced relation to said body of dielectric fluid and the supporting surface to determine the non-uniformity of the electric field, and power supply means connected to the electrode for establishing said electric field to electro-kinetically induce movement of the solid particles through the dielectric fluid at different rates of movement, means for collecting solid particles displaced from the supporting surface in response to said electro-kinetically induced movement, and separation control means connected to the field applying means for removing the influence of the electric field from said body of dielectric fluid to maintain an increase in concentration of said predetermined component resulting from the displacement of some of the solid particles from the supporting surface.

3. The combination of claim 2 wherein said dielectric fluid is a liquid the exposed surface of which is vertically spaced by an air gap from said electrode.

4. The combination of claim 3 wherein said confining means comprises a container on which said supporting surface is formed.

5. The combination of claim 4 wherein said electrode is vertically spaced from an exposed surface of the body of dielectric fluid by an air gap.

6. The combination of claim 2 wherein said confining means comprises a container on which said supporting surface is formed.

7. The combination of claim 2 wherein said electrode is vertically spaced from an exposed surface of the body of dielectric fluid by an air gap.

* * * * *